US011009319B1

(12) United States Patent
Morales et al.

(10) Patent No.: US 11,009,319 B1
(45) **Date of Patent: *May 18, 2021**

(54) INITIATOR ASSEMBLY THAT IS RESISTANT TO SHOCK

(71) Applicant: Reynolds Systems, Inc., Middletown, CA (US)

(72) Inventors: Emmanuel Morales, Middletown, CA (US); Michael B. Meadows, Middletown, CA (US); Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 136 days.

This patent is subject to a terminal disclaimer.

(21) Appl. No.: 16/280,069

(22) Filed: Feb. 20, 2019

Related U.S. Application Data

(63) Continuation-in-part of application No. 15/490,358, filed on Apr. 18, 2017, now Pat. No. 10,267,604.

(51) Int. Cl.
*F42B 3/12* (2006.01)
*F42B 3/13* (2006.01)

(52) U.S. Cl.
CPC ..... *F42B 3/124* (2013.01); *F42B 3/12* (2013.01); *F42B 3/13* (2013.01)

(58) Field of Classification Search
CPC .. F42B 3/12; F42B 3/103; F42B 3/121; F42B 3/124; F42B 3/125; F42B 3/13; F42B 3/195; F42B 3/198; F42C 19/12
USPC ..... 102/202.5, 202.7, 202.9, 202.14
See application file for complete search history.

(56) References Cited

U.S. PATENT DOCUMENTS 6,178,888 B1 * 1/2001 Neyer ..... F42B 3/124 102/202.14
6,851,370 B2 2/2005 Reynolds et al.
6,923,122 B2 8/2005 Hennings et al.
7,430,963 B2 10/2008 Hennings et al.
7,543,532 B2 6/2009 Nance
(Continued)

FOREIGN PATENT DOCUMENTS

DE 102014010179 B3 3/2015

OTHER PUBLICATIONS

U.S. Appl. No. 14/501,656, filed Sep. 30, 2014 entitled: "High G-Force Resistant Initiator Assembly Having an Exploding Foil Initiator".

*Primary Examiner* — James S Bergin
(74) *Attorney, Agent, or Firm* — Burris Law, PLLC

(57) ABSTRACT

An initiator assembly that includes a header body, a frame member, a plurality of terminals, an initiator chip, a plurality of contacts, and a support member. The frame member is coupled to the header body and defines an interior aperture. The terminals are received through the header body and the frame member. The initiator chip is received in the frame member and has a plurality of lands, a conductive bridge and a flyer that is disposed over the conductive bridge. Each of the contacts is soldered to an associated one of the terminals and an associated one of the lands. The support member is formed of plastic and encapsulates the frame member, the plurality of contacts, and a portion of the initiator chip. The support member forms a barrel aperture over the flyer. The input charge is formed of a secondary explosive and is disposed in-line with the barrel aperture.

32 Claims, 6 Drawing Sheets

(56) References Cited

U.S. PATENT DOCUMENTS

| | | | | |
|---|---|---|---|---|
| 7,571,679 | B2 | 8/2009 | Nance | |
| 7,661,362 | B2 | 2/2010 | Hennings et al. | |
| 7,690,303 | B2 | 4/2010 | Reynolds et al. | |
| 7,866,264 | B2 | 1/2011 | Nance | |
| 7,938,065 | B2 * | 5/2011 | Desai | F42B 3/121 102/202.5 |
| 8,100,043 | B1 | 1/2012 | Nance et al. | |
| 8,113,117 | B2 | 2/2012 | Nance | |
| 8,276,516 | B1 | 10/2012 | Nance et al. | |
| 8,408,131 | B1 | 4/2013 | Nance | |
| 8,485,097 | B1 | 7/2013 | Nance et al. | |
| 8,573,122 | B1 | 11/2013 | Nance et al. | |
| 8,701,557 | B2 | 4/2014 | Biggs et al. | |
| 8,726,808 | B1 | 5/2014 | Nance | |
| 9,038,538 | B1 | 5/2015 | Nance et al. | |
| 9,500,448 | B1 | 11/2016 | Nance et al. | |
| 9,816,790 | B2 | 11/2017 | Biggs et al. | |
| 9,879,951 | B2 | 1/2018 | Biggs et al. | |
| 10,267,604 | B1 * | 4/2019 | Morales | F42B 3/124 |
| 10,267,605 | B1 * | 4/2019 | Meadows | F42B 3/125 |
| 10,557,692 | B1 * | 2/2020 | Amendola | F42B 3/195 |
| 2017/0045342 | A1 | 2/2017 | Fisher et al. | |

* cited by examiner

INITIATOR ASSEMBLY THAT IS RESISTANT TO SHOCK

CROSS-REFERENCE TO RELATED APPLICATIONS

This application is a continuation-in-part of U.S. Ser. No. 15/490,358 filed Apr. 18, 2017, the disclosure of which is incorporated by reference as if fully set forth in detail herein.

FIELD

The present disclosure relates to an initiator assembly that is resistant to shock.

BACKGROUND

This section provides background information related to the present disclosure which is not necessarily prior art.

U.S. Pat. No. 7,571,679 discloses an energetic material initiation device with a header assembly that includes an exploding foil initiator. While this device works very well for its intended purpose, we have noted that in high-shock situations (i.e., where the device experiences high levels of shock before the device is operated) it is possible for the shock to crack the (compacted) input charge. The cracking of the input charge increases the risk that the input charge would fail to detonate.

We surmise that due to changes in elevation across the header assembly that are related to the thickness of the contacts, the thickness of the solder that is employed to secure the contacts to the exploding foil initiator, the thickness of the barrel, etc., the input charge is not supported to a maximum extent on a side adjacent the exploding foil initiator. Consequently, the void space between the header assembly and the input charge provides space for portions of the input charge to move by a sufficient amount in a high-shock situation to cause the input charge to crack.

SUMMARY

This section provides a general summary of the disclosure, and is not a comprehensive disclosure of its full scope or all of its features.

In one form, the present disclosure provides an initiator assembly that includes an input charge formed of a secondary explosive and a header assembly having a header body, a plurality of terminals, a plurality of seal members, an insulating spacer, a frame member, an initiator chip and a support member. The header body has an interior surface and a plurality of terminal apertures. Each of the seal members is received in an associated one of the terminal apertures and is sealingly engaged to the header body and an associated one of the terminals. The insulating spacer is abutted against the interior surface of the header body. The frame member overlies the insulating spacer and defines an interior aperture. The initiator chip has a plurality of bridge lands, a bridge and a flyer. Each of the bridge lands is electrically coupled to an associated one of the terminals. The flyer is disposed on a side of the bridge opposite the header body such that the bridge is disposed along an initiation axis between the flyer and the header body. The support member overlies a portion of the initiator chip and defines a first header surface with a central aperture formed there through. One of the initiator chip and the support member forms a barrel with a barrel aperture that is disposed in-line with the flyer and the bridge along the initiation axis. The first header surface has a flatness that is less than or equal to 0.006 inch.

In still another form, the present disclosure provides an initiator assembly that includes a header body, a frame member, a plurality of terminals, an initiator chip, a plurality of contacts, and a support member. The frame member is coupled to the header body and defines an interior aperture. The terminals are received through the header body and the frame member. The initiator chip is received in the frame member and has a plurality of lands, a conductive bridge and a flyer that is disposed over the conductive bridge. Each of the contacts is soldered to an associated one of the terminals and an associated one of the lands. The support member is formed of plastic and encapsulates the frame member, the plurality of contacts, and a portion of the initiator chip. The support member forms a barrel aperture over the flyer. The input charge is formed of a secondary explosive and is disposed in-line with the barrel aperture.

In yet another form, the teachings of the present disclosure provide an initiator assembly that includes an input charge, which is formed of a secondary explosive, and a header assembly having a header body, a plurality of terminals, a plurality of seal members, an initiator chip and a support member. The header body has an interior surface and a plurality of terminal apertures. Each of the seal members is received in an associated one of the terminal apertures and is sealingly engaged to the header body and an associated one of the terminals. The initiator chip is coupled to but electrically insulated from the header body. The initiator chip has a plurality of bridge lands, a bridge and a flyer. Each of the bridge lands is electrically coupled to an associated one of the terminals. The flyer is disposed on a side of the bridge opposite the header body such that the bridge is disposed along an initiation axis between the flyer and the header body. The support member overlies a portion of the initiator chip and defines a first header surface with a central aperture formed there through. One of the initiator chip and the support member includes a barrel that defines a barrel aperture. The barrel aperture is disposed in-line with the flyer and the bridge along the initiation axis. The first header surface has a flatness that is less than or equal to 0.006 inch.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
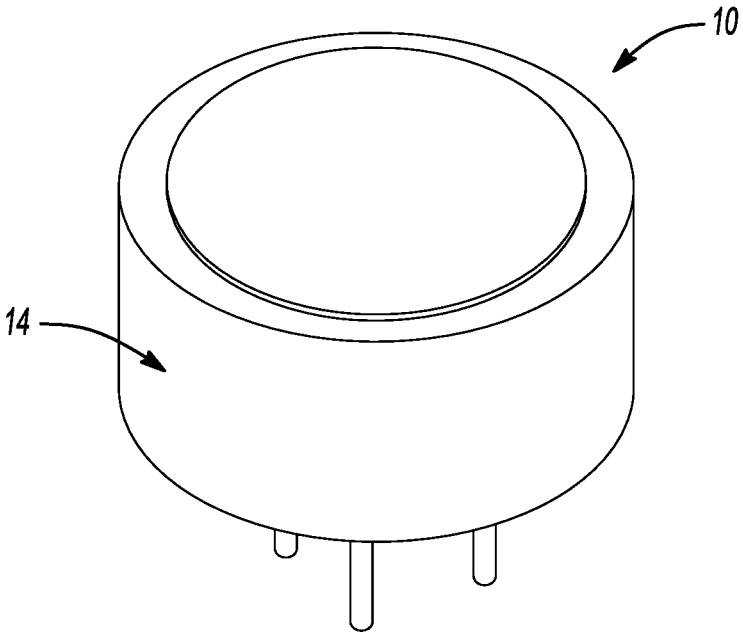
FIG. 1 is a perspective view of an exemplary initiator assembly constructed in accordance with the teachings of the present disclosure.
Figure 2:
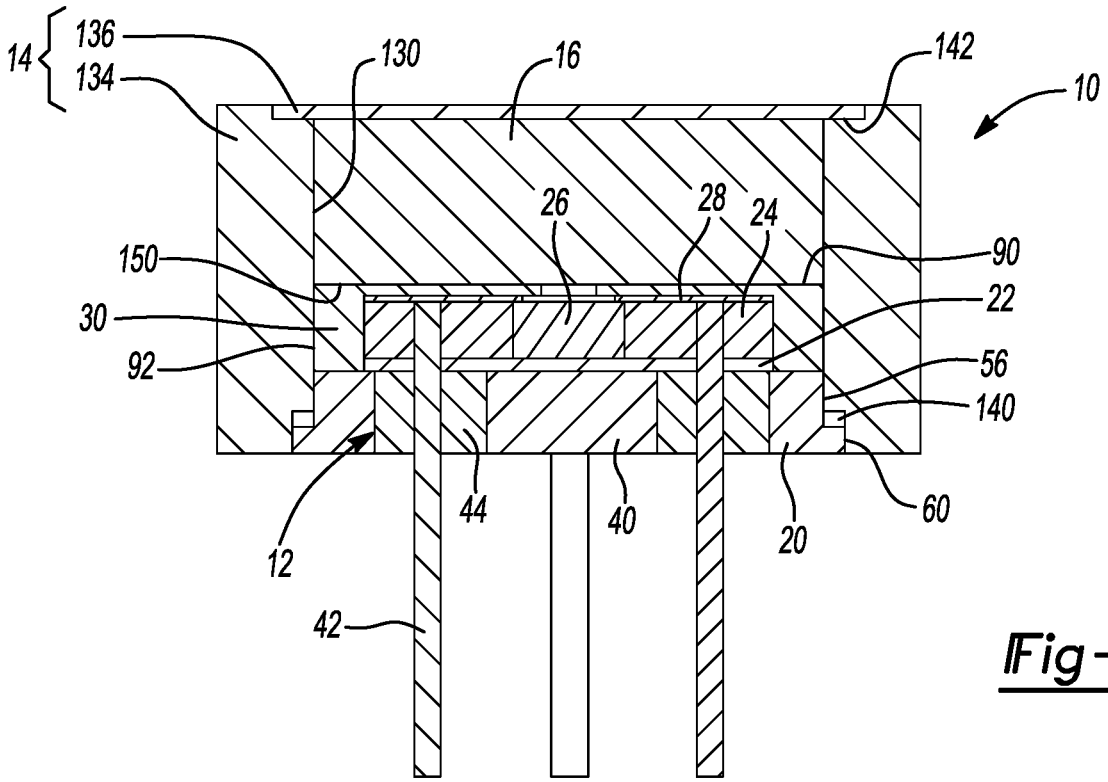
FIG. 2 is a longitudinal section view of the initiator assembly of FIG. 1.

With reference to FIGS. 1 and 2, an initiator assembly constructed in accordance with the teachings of the present disclosure is generally indicated by reference numeral 10. The initiator assembly 10 can include a header assembly 12, a cover 14, and an input charge 16.

Figure 3:
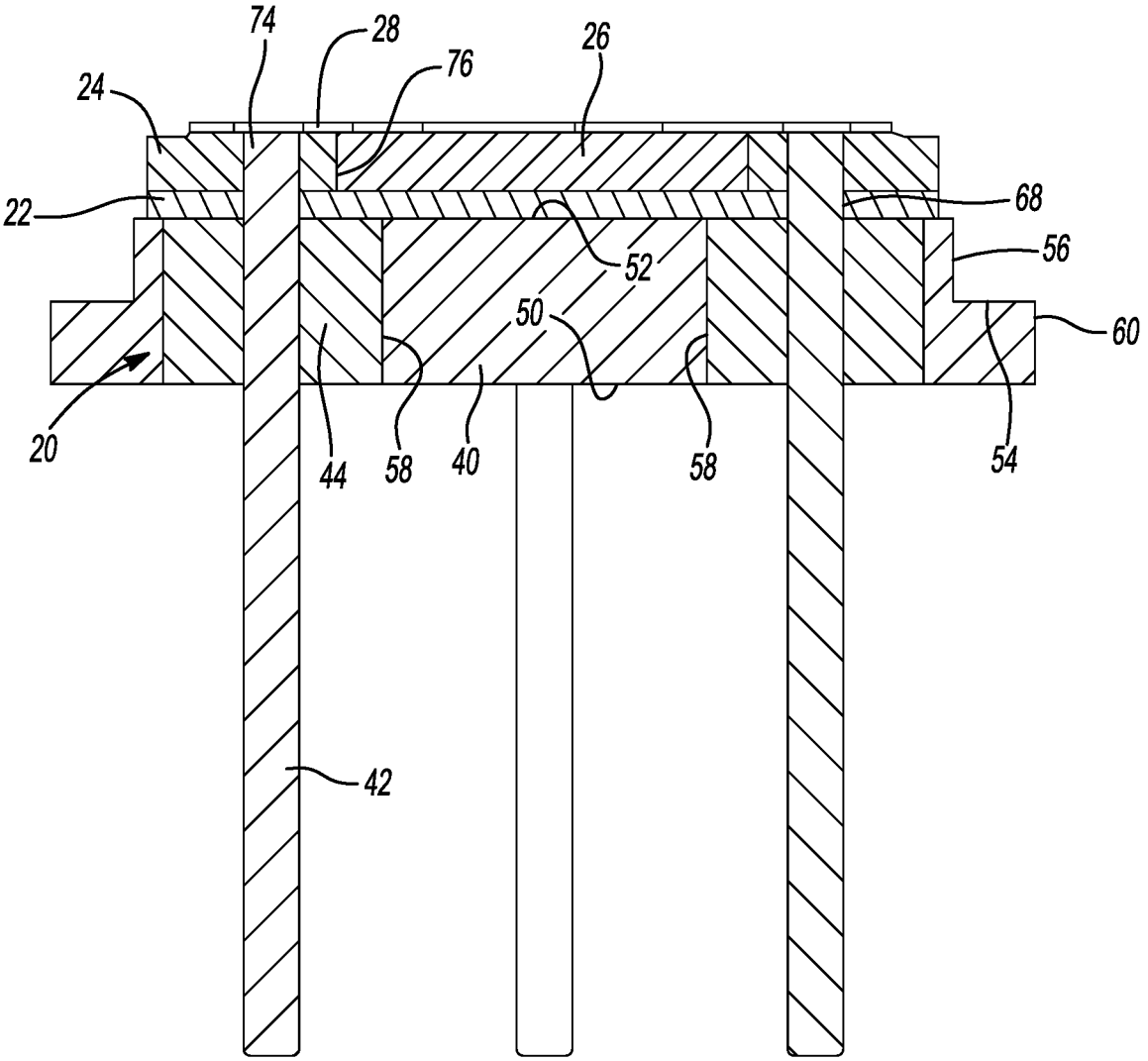
FIG. 3 is longitudinal section view of a portion of the initiator assembly of FIG. 1.

With reference to FIGS. 2 and 3, the header assembly 12 can include a header 20, an optional insulating spacer 22, an optional frame member 24, an initiator chip 26, a plurality of contacts 28 and a support member 30. The header 20 can include a header body 40, a plurality of terminals 42, and a plurality of seal members 44.

With reference to FIG. 3, the header body 40 can be formed of an appropriate material, such as KOVAR®, and can be shaped in a desired manner. The header body 40 can define first and second end faces 50 and 52, respectively, a shoulder 54, an annular shoulder wall 56, a plurality of terminal apertures 58 and an outer circumferentially extending surface 60. The shoulder 54 can be generally parallel to the first and second end faces 50 and 52 and can abut the annular shoulder wall 56. The shoulder wall 56 and the outer circumferentially extending surface 60 can be concentric with one another and can be disposed generally perpendicular to the shoulder 54. The terminal apertures 58 can be formed through the header body 40 generally perpendicular to the first and second end faces 50 and 52.

The terminals 42 can be received in respective ones of the terminal apertures 58 and can extend outwardly from the first and second end faces 50 and 52. It will be appreciated that the terminals 42 can be arranged in a non-symmetrical manner to thereby key the header 20 in a particular orientation relative to a fireset device (not shown) to which the initiator assembly 10 is to be coupled. It will also be appreciated that a keying feature, such as a tab (not shown) or a recess (not shown), can be incorporated into a portion of the header 20 (e.g., the header body 40) to key the header 20 in a particular orientation.

The seal members 44 can be formed of a suitable material, such as glass conforming to 2304 Natural or another dielectric material, and can be received into an associated one of the terminal apertures 58. The seal members 44 can sealingly engage the header body 40 as well as an associated one of the terminals 42.

The insulating spacer 22 can be formed of a suitable dielectric material, such as polycarbonate, synthetic resin bonded paper (SRBP) or epoxy resin bonded glass fabric (ERBGF), and can have a plurality of clearance apertures 68 that are sized to receive the terminals 42 there through. The insulating spacer 22 can be received onto the second end face 52 and within an area that is defined by the size (i.e., perimeter) of the annular shoulder wall 56.

Figure 4:
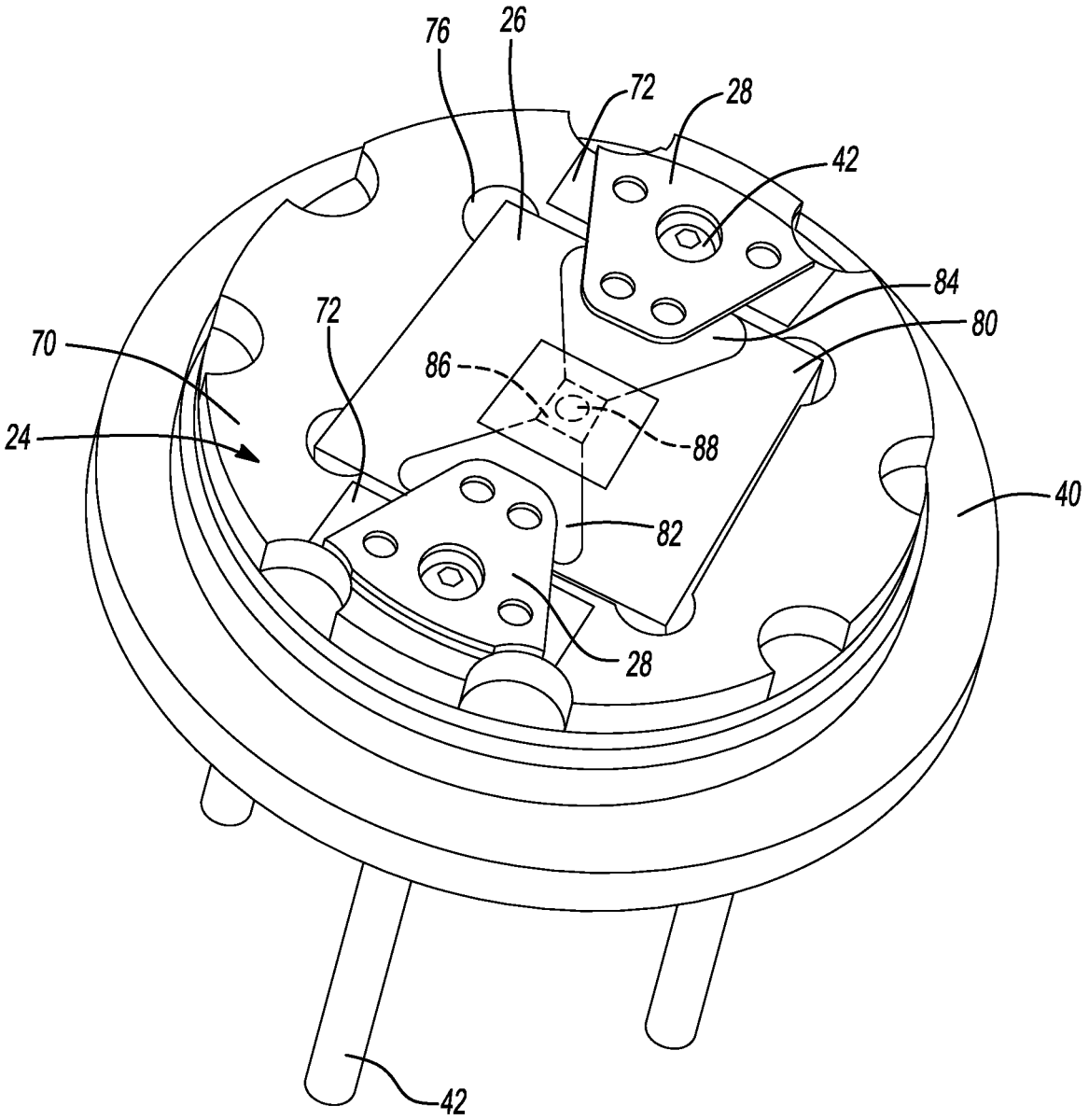
FIG. 4 is a perspective view of the portion of the initiator assembly that is depicted in FIG. 3.

With reference to FIGS. 3 and 4, the frame member 24 can include a body 70 and a plurality of electrical conductors 72. The body 70 can be formed of an appropriate dielectric material, such as synthetic resin bonded paper (SRBP) or epoxy resin bonded glass fabric (ERBGF). The conductors 72 can be arranged about the body 70 in a predetermined manner and can comprise one or more conductive layers of material, such as gold, silver, copper, nickel and alloys thereof. The conductors 72 can be formed onto the body 70 in any desired manner, such as through metallization of the entire surface of the body 70 and acid-etch removal of portions of the metallization that are not desired. The frame member 24 can be sized and shaped to closely conform to the size and shape of the insulating spacer 22 and can include a plurality of terminal apertures 74, and an interior aperture 76 that is sized to receive the initiator chip 26. The terminal apertures 74 can be sized to receive a corresponding one of the terminals 42 therein.

The initiator chip 26 is configured to be fixedly coupled to but electrically insulated from the header body 40. With reference to FIG. 4, the initiator chip 26 can include a base 80, a pair of bridge lands 82 and 84, a bridge 86, and a flyer 88. The base 80 can be a structural member that can be formed of a generally non-conductive material, such as a ceramic. The bridge lands 82 and 84 and the bridge 86 can be fixedly coupled to the base 80 in a suitable manner (e.g., via vapor deposition) and can be formed of one or more layers of metallic material, including copper, silver, nickel, gold and alloys thereof. In the particular example provided, the bridge lands 82 and 84 and the bridge 86 are directly mounted to the base 80, but it will be appreciated that if desired, one or both of the bridge lands 82 and 84 and/or the bridge 86 can be mounted fully or partly on another layer of the initiator chip 26 (e.g., a non-metal material layer that is employed to form the flyer 88). The bridge 86, which is disposed between the bridge lands 82 and 84, is electrically coupled to the bridge lands 82 and 84 there between in the example provided. It will be appreciated, however, that one or more of the bridge lands 82 and 84 can be electrically isolated from the bridge 86 if desired. Examples of configurations where the bridge 86 is electrically isolated from one or more of the lands that are disposed in an electric transmission path for power that is employed to vaporize the bridge 86 are disclosed in commonly assigned U.S. Pat. No. 7,543,532 issued Jun. 9, 2009 entitled "Full Function Initiator With Integrated Planar Switch" and U.S. Pat. No. 9,500,448 issued Nov. 22, 2016 entitled "Bursting Switch", the disclosures of which are incorporated by reference as if fully set forth in detail herein. The flyer 88 can be formed of a suitable non-metal material layer such as polyamide. The non-metal material layer that forms the flyer 88 can be deposited over the bridge 86 on a side of the bridge 86 that faces away from the base 80.

Each of the contacts 28 can be formed of a suitable electrically conductive material, such as KOVAR®, and can electrically couple an associated one of the terminals 42 to an associated one of the bridge lands 82 and 84. In the example provided, each of the contacts 28 is soldered to an associated one of the terminals 42 and an associated one of the bridge lands 82 and 84. While the contacts 28 and the layer of solder between the contacts 28 and the bridge lands 82 and 84 can be relatively small, their presence significantly affects the overall flatness across the side of the initiator chip 26 that faces away from the second end face 52 (FIG. 3) of the header body 40. In this regard, the presence of the contacts 28 and the solder can protrude over a portion of the initiator chip 26 that is furthest from the second end face 52 (FIG. 3) of the header body 40 by a first flatness that has a magnitude that is greater than or equal to a first predetermined dimension.

Figure 5:
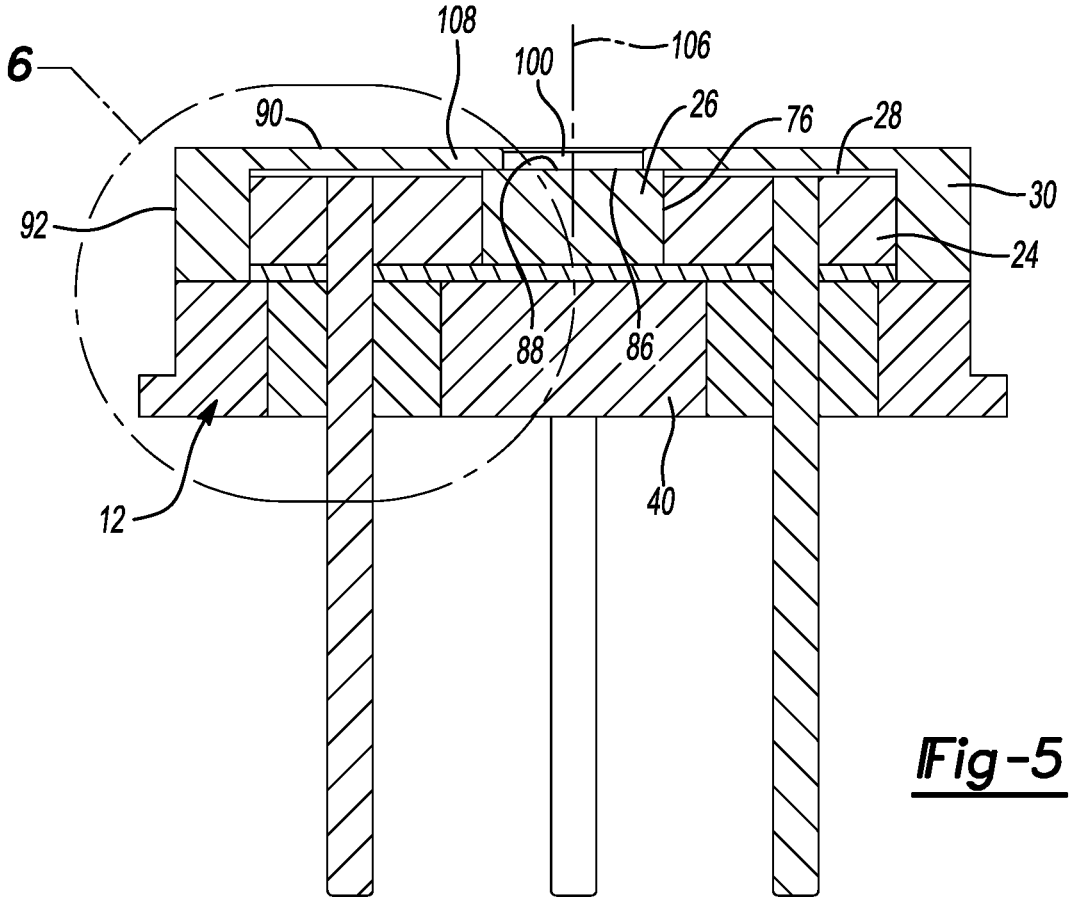
FIG. 5 is a longitudinal section view of a portion of the initiator assembly of FIG. 1.
Figure 6:
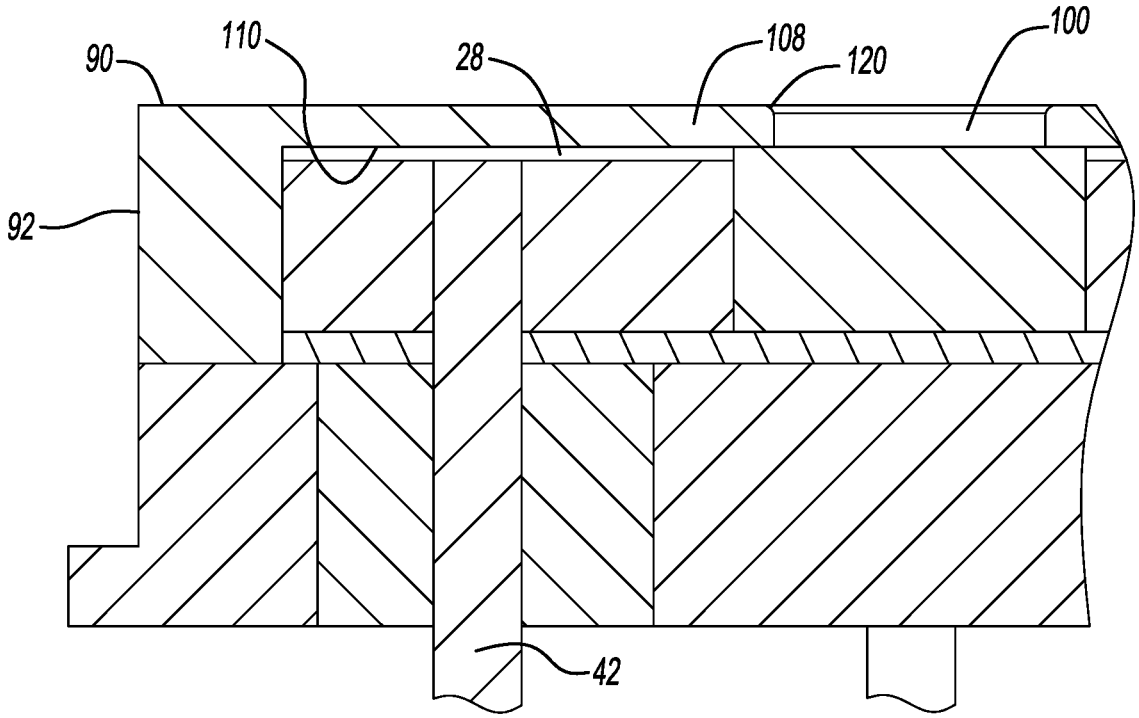
FIG. 6 is an enlarged portion of FIG. 5.

With reference to FIGS. 5 and 6, the support member 30 can be disposed over the initiator chip 26 and the contacts 28 to create a first header surface 90 and a circumferentially extending sidewall 92. The first header surface 90 can extend above a surface of the initiator chip 26 that faces the support member 30 by a distance that is less than or equal to 0.030 inch and can be greater than or equal to 0.004 inch. The distance between the surface of the initiator chip 26 and the first header surface 90 can preferably be less than or equal to 0.015 inch. The first header surface 90 can define a through-bore 100 that is disposed in-line with the bridge 86 and the flyer 88 along the initiation axis 106. In the example provided, the support member 30 defines a barrel 108 in which the through-bore 100 is a "barrel aperture" through which the flyer 88 travels when the initiator assembly 10 (FIG. 1) is operated. It will be appreciated that the initiator chip 26 and the barrel 108 form an exploding foil initiator. It will also be appreciated that the barrel 108 could be assembled to the initiator chip 26 and that the support member 30 could thereafter be disposed over the initiator chip 26 (including the barrel 108), in which case the through-bore 100 would be formed along the initiation axis 106 to a size that is greater than or equal to a size of a barrel aperture formed in the barrel 108. The first header surface 90 can be relatively flat, having a second flatness that has a magnitude that is less than the first predetermined dimension. Preferably the magnitude of the second flatness is significantly less than the first predetermined dimension, such as less than or equal to 0.006 inch, and more preferably less than or equal to 0.001 inch. In the example provided, the circumferentially extending wall 92 is sized equal to the size (diameter) of the annular shoulder wall 56 on the header body 40 so that the support member is disposed over the entirety of the frame member 24

If desired, the support member 30 can be pre-formed and assembled to the initiator chip 26, the contacts 28 and the header body 40. In such case, it may be beneficial to have a substance, such as an epoxy adhesive, that is disposed between the support member 30 and the initiator chip 26 and the contacts 28 to secure the support member 30 to the initiator chip 26 and the contacts 28 and/or to fill void spaces that might otherwise be present between an interior surface 110 of the support member 30 and surfaces of the initiator chip 26 and the contacts 28. In the present example, the support member 30 is formed via injection molding directly onto the remainder of the header assembly 12 (i.e., the portion of the header assembly 12 that excludes the support member 30) so that no void spaces are present between the support member 30 and the initiator chip 26 and the support member 30 can be cohesively bonded to the initiator chip 26, the contacts 28, the frame member 24 and the second end surface 52 of the header body 40. Configuration in this manner encapsulates the insulating spacer 22, the frame member 24, the ends of the terminals 42 that are received through the seal members 44, the initiator chip 26 and the contacts 28, which can improve the overall rigidity of the header assembly 12. Molding of the support member 30 directly onto the remainder of the header assembly 12 also permits the barrel aperture (i.e., the through-bore 100 in the example provided) to be formed with a fillet radius 120 on a side of the barrel 108 that faces away from the bridge 86. Suitable materials from which the support member 30 may be formed via molding include polycarbonate, including optically transparent polycarbonates, and liquid-crystal polymer (LCP).

With reference to FIG. 4, the terminals 42 are disposed through the frame member 24 at locations that are outwardly of the interior aperture 76 and the contacts 28 are employed to interconnect the terminals 42 to the bridge lands 82 and 84 in the example provided. It will be appreciated that one or more of the terminals 42 could be disposed through the frame member 24 at locations that are within the interior aperture 76 and that in such case, the use of a contact 28 to interconnect the terminal 42 to an associated one of the bridge lands 82 and 84 may not be needed.

Returning to FIG. 2, the cover 14 can be fixedly coupled to the header assembly 12 and can define a cavity 130 into which the input charge 16 can be received. The input charge 16 can be formed of a suitable high-explosive material, such as a secondary explosive. The cover 14 can be unitarily and integrally formed (e.g., as a cup-like structure that is formed via extrusion or drawing), but in the particular example provided, the cover 14 includes a cover housing 134 and a cover member 136. The cover housing 134 can be a hollow-tubular structure having a central aperture that defines the cavity 130, a first counterbore 140 and a second counterbore 142. The central aperture/cavity 130 can be sized to slidingly engage the annular shoulder wall 56 and the circumferentially extending wall 92 of the support member 30. The first counterbore 140 can be formed on a first axial end of the cover housing 134 and can be sized to receive the shoulder 54 and the outer circumferentially extending surface 60 of the header body 40 therein. The header body 40 and the cover housing 134 can be fixedly coupled to one another in any desired manner, such as welding (e.g., laser welding). The second counterbore 142 can be formed on a second, opposite end of the cover housing 134 and can be sized to receive the cover member 136 therein. The cover housing 134 and the cover member 136 can be fixedly coupled to one another in any desired manner, such as welding (e.g., laser welding). It will be appreciated that the welding of the header body 40 and the cover member 136 to the cover housing 134 can be done in such a manner as to hermetically seal the cavity 130. It will be appreciated that the cover 14 could be sized differently from that which is shown here and that the cavity 130 could be sized to accommodate one or more supplemental charges of energetic material, such as high-explosive material or pyrotechnic (low explosive) material.

Figure 7:
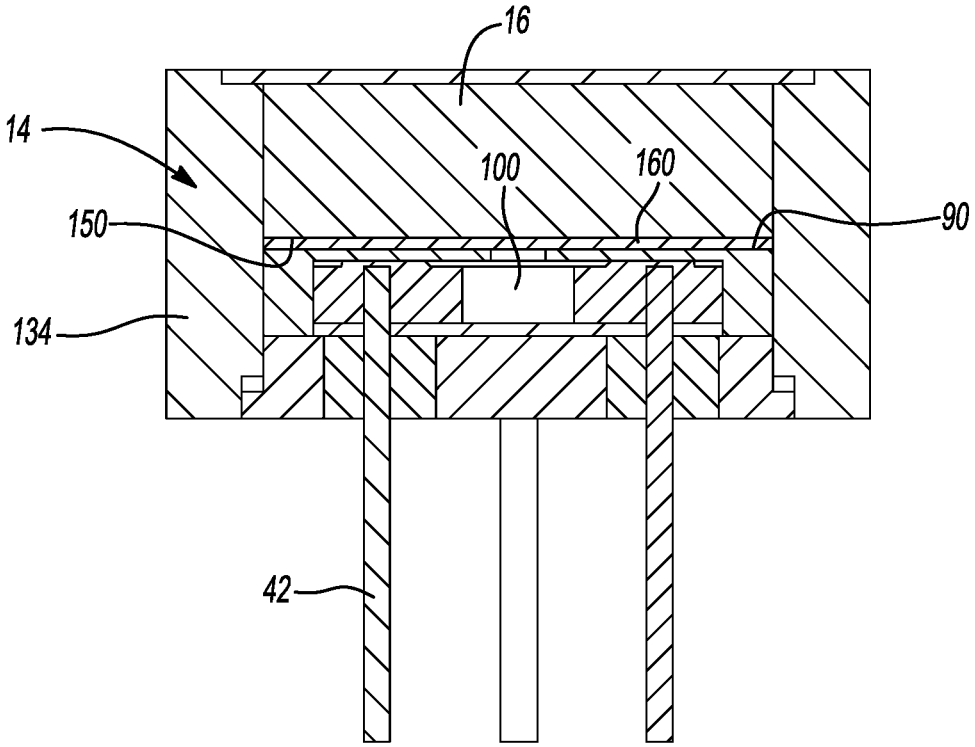
FIG. 7 is a longitudinal section view of another initiator assembly constructed in accordance with the present disclosure.

The input charge 16 can be received in the cavity 130 and can have an axial end 150 that can be abutted directly against the first header surface 90. Optionally, as shown in FIG. 7, a barrier 160 can be disposed between the first header surface 90 of the support member 30 and the axial end 150 of the input charge 16. The barrier 160 can be configured to inhibit the material that forms the input charge 16 from breaking apart and falling into the barrel aperture (i.e., the through-bore 100 in the example provided) onto the flyer 88 (FIG. 4). The barrier 160 can be formed of an appropriate structural material, such as a plastic, ceramic, composite and/or metallic material, and can have a thickness that is sufficient to provide the desired level of support. In the particular example provided, the barrier 160 is formed of titanium, but it will be appreciated that various other metals can be selected, including steel, aluminum and stainless steel. The thickness of the barrier 160 can be less than or equal to 0.01 inch and preferably less than or equal to 0.005 inch. In the particular example provided, the barrier 160 has a thickness of 0.001 inch. Optionally, the barrier 160 can be fixedly coupled to the cover 14 in any desired manner, such as by press-fitting it to the cover housing 134.

Returning to FIG. 2, while the support member 30 has been illustrated and described as overlying the entirety of the frame member 24 and being bonded to the second end surface 52 (FIG. 3) of the header body 40, it will be appreciated that the support member 30 could be sized somewhat smaller, which might be appropriate in situations where the input charge 16 was smaller than shown in the present example and did not extend outwardly of the frame member 24.

Figure 8:
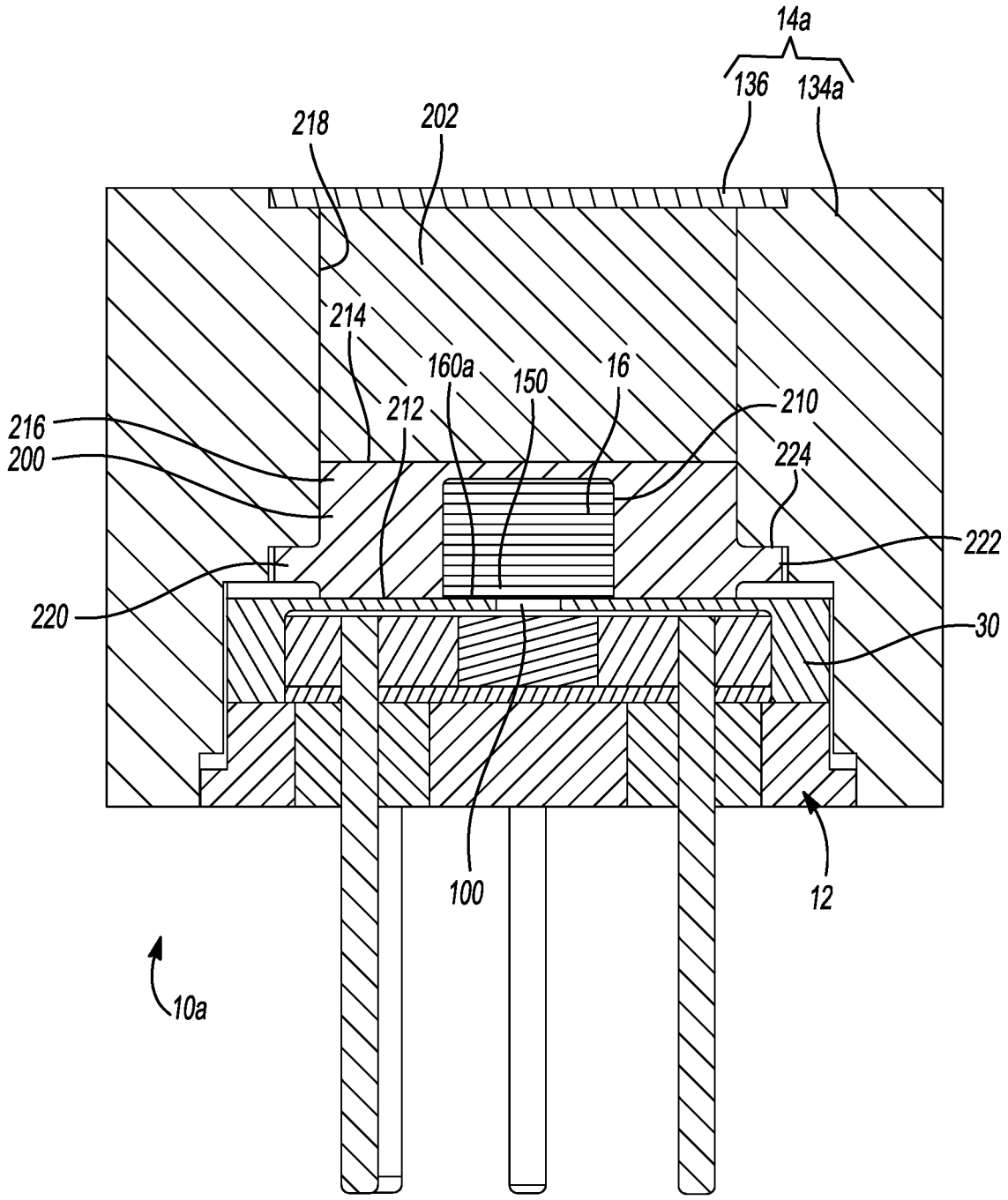
FIG. 8 is a longitudinal section view of another initiator assembly that is constructed in accordance with the teachings of the present disclosure.

With reference to FIG. 8, another initiator assembly constructed in accordance with the teachings of the present disclosure is generally indicated by reference numeral 10*a*. The initiator assembly 10*a* can include the header assembly 12, which is described in detail above, a cover 14*a*, the input charge 16, an input charge housing 200 and an output charge 202. The cover 14*a* can include a cover housing 134*a*, which is similar to the cover housing 134 (FIG. 2) described above except as described in detail below, and the cover member 136.

The input charge housing 200 is configured to retain and/or constrain the input charge 16 and can be employed to segregate the input charge 16 from the output charge 202. The input charge housing 200 can be formed of an appropriate material, such as a rigid plastic or metal material, and can define an input charge bore 210 into which the input charge 16 can be received. The input charge housing 200 has a first axial surface 212, which is disposed proximate or adjacent the support member 30, and a second axial surface 214 that is disposed opposite the first axial surface 212. In the example provided, the input charge bore 210 is a blind bore that extends only through the first axial surface 212. It will be appreciated, however, that the input charge bore 210 could be formed differently and could extend through the second axial surface 214. The input charge housing 200 can be assembled to the cover housing 134*a* in any desired manner. For example, the input charge housing 200 can have a housing body 216 that can be slidably received in a housing bore 218 formed in the cover housing 134*a*. In the example provided, the input charge housing 200 includes a flange member 220 that is disposed about and extends outwardly from the housing body 216, while the cover housing 134*a* defines a counterbore 222 with a shoulder 224; the flange member 220 is received into the counterbore 222 and the flange member 220 is abutted to the shoulder 224. The input charge housing 200 can be retained to the cover housing 134*a* in any desired manner. For example, threaded fasteners, mating external and internal threads (on the housing body 216 and cover housing 134*a*, respectively), one or more welds and/or an adhesive can be employed to fixedly couple the input charge housing 200 to the cover housing 134*a*. In the embodiment shown, however, a continuous butt weld between the flange member 220 of the input charge housing 200 and the perimeter of the counterbore 222 in the cover housing 134*a* is employed to fixedly couple the input charge housing 200 to the cover housing 134*a*, as well as to seal a portion of the volume of the housing bore 218 at a location between the output charge 202 and the header assembly 12. The input charge 16 can be consolidated into the input charge bore 210, or could be pre-formed (compressed) as one or more pellets and inserted into the input charge bore 210.

As in the above-described example, a barrier 160*a* can be disposed between the first header surface 90 of the support member 30 and the axial end 150 of the input charge 16. The barrier 160*a* can be configured to inhibit the material that forms the input charge 16 from breaking apart and falling into the barrel aperture (i.e., the through-bore 100 in the example provided) onto the flyer 88 (FIG. 4). The barrier 160*a* can be formed of an appropriate structural material, such as a plastic, ceramic, composite and/or metallic material, and can have a thickness that is sufficient to provide the desired level of support. In the particular example provided, the barrier 160*a* is formed of titanium and is received in the input charge bore 210 in the input charge housing 200, but it will be appreciated that various other metals can be selected, including steel, aluminum and stainless steel and/or that the barrier 160*a* could span or lie across the first axial surface 212 of the input charge housing 200 and could be trapped between the input charge housing 200 and the support member 30, or could be fixedly coupled to the input charge housing 200. The thickness of the barrier 160*a* can be less than or equal to 0.01 inch and preferably less than or equal to 0.005 inch. In the particular example provided, the barrier 160*a* has a thickness of 0.001 inch.

If it is included, the output charge 202 can be formed of a suitable energetic material, such as an explosive material (i.e., a material that is intended to detonate) or a pyrotechnic material (i.e., a material that is intended to combust). In the example provided, the output charge 202 is formed of a secondary explosive material. The output charge 202 is received between the cover member 136 and the input charge housing 200. In the example shown, the output charge 202 abuts the second axial surface 214 of the input charge housing 200 and extends to the perimeter of the housing bore 218 in the cover housing 134*a*. The output charge 202 can be consolidated into the housing bore 218, or could be pre-formed (compressed) as one or more pellets and inserted into the housing bore 218.

If it is included, the cover member 136 can be retained or fixedly coupled to the cover housing 134*a* in a manner that is similar to that which is described above for the retention or coupling of the cover member 136 to the cover housing 134 (FIG. 2).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

an input charge formed of a secondary explosive material; and a header assembly that includes a header body, a plurality of terminals, a plurality of seal members, an initiator chip and a support member, the header body having an interior surface and a plurality of terminal apertures, each of the seal members being received in an associated one of the terminal apertures and being sealingly engaged to the header body and an associated one of the terminals, the initiator chip being coupled to but electrically insulated from the header body, the initiator chip having a plurality of bridge lands, a bridge and a flyer, each of the bridge lands being electrically coupled to a corresponding one of the terminals, the flyer being disposed on a side of the bridge opposite the header body such that the bridge is disposed along an initiation axis between the flyer and the header body, the support member overlying a portion of a surface of the initiator chip and defining a first header surface with a central aperture formed there through, wherein one of the initiator chip and the support member comprises a barrel, the barrel defining a barrel aperture that is disposed in-line with the flyer and the bridge along the initiation axis, and wherein the first header surface has a flatness that is less than or equal to 0.006 inch.

2. The initiator assembly of claim 1, wherein the support member has a second header surface that faces the portion of the surface of the initiator chip that the support member overlies, and wherein the second header surface is in conforming contact with the entirety of the portion of the surface of the initiator chip that the support member overlies.

3. The initiator assembly of claim 2, wherein the support member is bonded to the portion of the surface of the initiator chip that the support member overlies.

4. The initiator assembly of claim 3, wherein the support member forms the barrel.

5. The initiator assembly of claim 4, wherein a fillet radius is formed on the barrel aperture on a side of the barrel that faces away from the bridge.

6. The initiator assembly of claim 1, wherein the terminals are received through the header body at locations that are outwardly of the initiator chip.

7. The initiator assembly of claim 6, further comprising a plurality of contacts, each of the contacts being fixedly and electrically coupled to a respective one of the bridge lands and a respective one of the terminals, the support member overlying at least a portion of each one of the contacts.

8. The initiator assembly of claim 1, further comprising a cover coupled to the header body, wherein the input charge is received in the cover.

9. The initiator assembly of claim 8, wherein the input charge has an axial end that is abutted against the support member.

10. The initiator assembly of claim 8, further comprising a barrier that is interposed between the secondary explosive material and the support member.

11. The initiator assembly of claim 10, wherein the barrier comprises a metallic layer.

12. The initiator assembly of claim 11, wherein the metallic layer is formed of a metal selected from a group consisting of titanium, aluminum, steel, stainless steel, and combinations of two or more thereof.

13. The initiator assembly of claim 8, wherein the cover comprises a cover housing and a cover member, the cover housing being fixedly coupled to the header body, the cover member being fixedly coupled to an end of the cover housing on a side opposite the header body.

14. The initiator assembly of claim 13, further comprising an input charge housing that defines an input charge bore into which the input charge is received, the input charge housing being received in a housing bore formed in the cover housing.

15. The initiator assembly of claim 14, wherein the cover housing defines a counterbore having a shoulder, wherein the input charge housing has a housing body and a flange member that is disposed about the housing body, and wherein the flange member is received in the counterbore and abutted to the shoulder.

16. The initiator assembly of claim 14, wherein the input charge bore is formed into a first axial surface of the input charge housing and wherein the input charge bore does not extend through a second axial surface that is opposite the first axial surface.

17. The initiator assembly of claim 14, wherein an output charge is received in the cover housing between the cover member and the input charge housing.

18. The initiator assembly of claim 17, wherein the output charge is formed of an explosive material.

19. The initiator assembly of claim 18, wherein the explosive material is a secondary explosive material.

20. The initiator assembly of claim 14, further comprising a barrier that is located along the initiation axis between the input charge and the first header surface.

21. The initiator assembly of claim 20, wherein the barrier comprises a metallic layer.

22. The initiator assembly of claim 21, wherein the metallic layer is formed of a metal selected from a group consisting of titanium, aluminum, steel, stainless steel, and combinations of two or more thereof.

23. The initiator assembly of claim 20, wherein the barrier is received in the input charge bore.

24. The initiator assembly of claim 14, wherein the input charge housing is fixedly coupled to the cover housing.

25. The initiator assembly of claim 24, wherein the input charge housing is welded to the cover housing.

26. The initiator assembly of claim 14, wherein the input charge housing is formed of a metal material.

27. The initiator assembly of claim 1, wherein the support member extends above the surface of the initiator chip on the side of the initiator chip that faces toward the input charge by a distance that is less than or equal to 0.030 inch and greater than or equal to 0.004 inch.

28. The initiator assembly of claim 27, wherein the distance is less than or equal to 0.015 inch.

29. The initiator assembly of claim 1, wherein the header assembly further comprises an insulating spacer, which is disposed between the header body and the initiator chip, and a frame member that overlies the insulating spacer and which defines an interior aperture into which the initiator chip is received, wherein the support member abuts a surface of the header body and wherein the insulating spacer and the frame member are received within the support member.

30. The initiator assembly of claim 29, wherein the support member is bonded to the surface of the header body.

31. The initiator assembly of claim 1, wherein the flatness of the first header surface is less than or equal to 0.001 inch.

32. The initiator assembly of claim 1, wherein the support member is formed of a transparent material.

* * * * *